US005871247A

United States Patent [19]

Greenwell et al.

[11] Patent Number: 5,871,247

[45] Date of Patent: Feb. 16, 1999

[54] CRANE WHEEL PULLER

[75] Inventors: John B. Greenwell, Newburgh, Ind.; Charles E. Lander, Henderson, Ky.; David L. Williamson, Newburgh, Ind.; Stanley G. Barrett, Henderson, Ky.; Linda Ingram, Boonville; Gary K. Jeffries, Newburgh, both of Ind.; Donald K. Whitledge, Henderson, Ky.; Edwin A. Kuhn, Evansville, Ind.; James E. Havener, Boonville, Ind.; Michael F. Virden, Newburgh, Ind.; John H. Scott, Boonville, Ind.

[73] Assignee: Aluminum Company of America, Pittsburgh, Pa.

[21] Appl. No.: 699,598

[22] Filed: Aug. 9, 1996

[51] Int. Cl.[6] ..... B66C 1/18

[52] U.S. Cl. ..... 294/67.5; 294/81.3; 294/119.2

[58] Field of Search ..... 294/67.1, 67.21, 294/67.22, 67.3, 67.4, 67.41, 67.5, 81.1, 81.2, 81.3, 81.55, 82.12, 74, 86.4, 103.1, 119.2

[56] References Cited

U.S. PATENT DOCUMENTS

| | | | |
|---|---|---|---|
| 2,329,008 | 9/1943 | Smith | 294/67.5 |
| 3,275,367 | 9/1966 | Bopp | 294/81.3 |
| 3,675,961 | 7/1972 | Wheeler | 294/67.1 |
| 4,615,656 | 10/1986 | Geraghty, Jr. | 294/103.1 |
| 4,818,004 | 4/1989 | Oswalt et al. | 294/67.22 |

FOREIGN PATENT DOCUMENTS

| | | | |
|---|---|---|---|
| 1480384 | 5/1967 | France | 294/81.3 |
| 616-221 | 7/1978 | U.S.S.R. | 294/67.21 |
| 1557-068 | 4/1990 | U.S.S.R. | 294/67.5 |

*Primary Examiner*—Dean Kramer

*Attorney, Agent, or Firm*—Elroy Strickland; Gary P. Topolosky

[57] ABSTRACT

A wheel puller for handling a heavy wheel assembly. The puller comprises a beam having one end for securing a heavy wheel assembly thereto, and an opposite end having a weight member connected thereto. The weight member has a mass comparable to the wheel assembly. At a location intermediate the beam ends, the hook of a lifting device is received.

18 Claims, 4 Drawing Sheets

CRANE WHEEL PULLER

BACKGROUND OF THE INVENTION

The present invention relates generally to overhead cranes used in present-day industries, and more particularly to means for removing worn or broken wheel assemblies from such cranes and reinstalling spare wheel assemblies.

Industrial overhead cranes comprise an "end truck" having four or more wheels that ride on overhead parallel rails located near the ceilings of industrial plants and factories. End trucks support the ends of a bridge of an overhead crane that spans the distance between the parallel overhead rails. Such cranes and trucks are, of course, used to transport heavy objects that can be lifted and lowered by an electrical winch or winches that are an integral part of such cranes.

Figure 4:
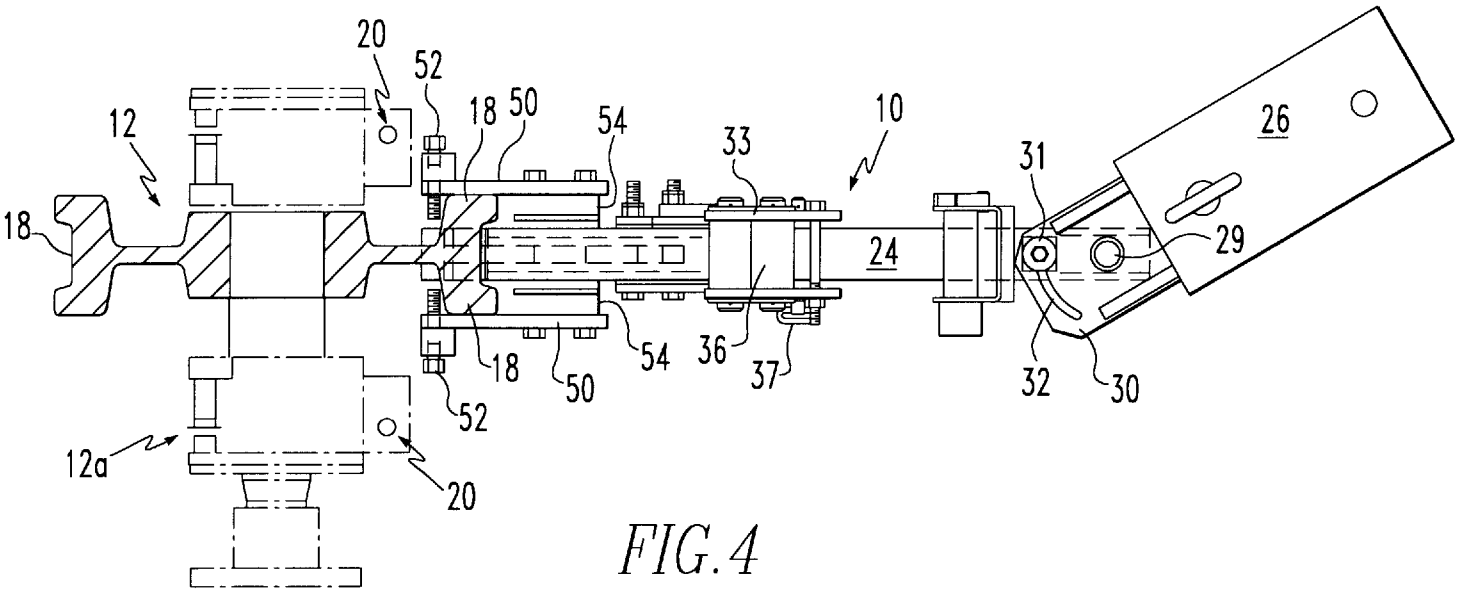

The wheels of most domestic crane trucks have double flanges, as depicted in FIG. 4 of the subject drawings, that maintain the wheels on the parallel rails, but some wheels have only one flange, and some have none. In addition, each wheel is an assembly of components that includes bearings, spindles, bearing races and housings (that house the bearings), shafts, flanges and other components. The wheels per se are forged steel structures that can be brittle such that the wheel flanges break or running surfaces become worn, which then requires replacement of the wheel assembly. In addition, bearings, bearing races and wheel spindles and shafts become worn, which, again, requires removal of the worn assembly and reinstallation of a spare wheel assembly.

The precision at which crane wheel components are required to operate may not be apparent, but it can be appreciated that the overhead rails upon which the crane travels must be as near perfectly parallel as possible. Otherwise, the wheels and wheel assemblies will not "track" the rails properly, and will be subject to lateral forces imposed upon wheel flanges and other wheel components while traveling on the rails. Precise alignment of the end truck, wheel assembly and crane wheels is critical due to the following: Wheel flanges that ride on the rails cause a high amount of friction resulting in: (1) wheel wear ($15,000 each), (2) rail wear, which are, of course, difficult to change, (3) increased motor loads on crane drive system, resulting in blown fuses and motor damage. This can result in inability to move the crane in a desired direction.

Heretofore, the industry accepted practice of removing worn or damaged crane wheel assemblies, with each assembly weighing as much as 2000 pounds or more, is unbolting the wheel assembly from the crane truck, manually rolling the wheel assembly unsupported out from under the end of the truck longitudinally along the rail beneath the truck and wheel, and then placing a "choker" cable around the wheel so that the wheel could be lowered to the floor by a separate, floor operated, mobile crane. Personnel handling, actually manhandling, such assemblies worked from catwalks provided at the level of the rails.

Such a procedure places the mechanics working on the overhead crane at substantial risk due to the heavy wheel assembly being unsupported for the period of time it is removed from the crane truck to the occasion the floor crane is connected to the choker cable. In the case of overhead cranes used in potrooms that electrolytically smelt aluminum metal, strong magnetic fields are present that pull and jerk the wheel assembly about, as the magnetic fields acting on the assembly and on other iron and steel structures in and of the building housing the potrooms repel and attract the assembly such that it can be wrenched free of the personnel handling the wheel and either fall to ground level or fall back upon the catwalk and on personnel working on the catwalk. The strong magnetic fields are caused by electrical current flowing in large buses supplying current to the electrolytic cells of the potline.

SUMMARY OF THE INVENTION

The present invention provides a portable wheel puller liftable to the location of an overhead crane by the extended boom of a crane operated at floor level or other suitable device. The wheel puller comprises a horizontal beam provided with a weight located at one end of the beam and a saddle for receiving the periphery of a wheel at the other end of the beam. The mass of the weight is comparable to that of the wheel assembly to be removed and to the spare wheel to be inserted in place of the wheel removed. Thus, the mass of the weight counters that of the wheel assembly secured to the wheel puller to provide a balanced structure for lifting to and lowering from the elevated location of an overhead crane.

When disposed in the saddle of the wheel puller, the wheel is secured to the wheel puller by a strap having one end attached to the beam of the wheel puller and the other end attached to a tie-down ratchet and winch also located on the beam. The strap is manually placed around the periphery of the wheel and then drawn tight by the winch. After the wheel is installed, or is lowered to ground level after being removed from the crane truck, the strap is loosened by reverse operation of the winch and removed from the periphery of the wheel.

It can be readily appreciated that with such a wheel puller mechanics and other personnel do not have to manhandle a "loose" wheel assembly. Their task is greatly simplified and their safety substantially enhanced when removing and installing a wheel, as a floor operated crane can guide the wheel longitudinally along the rail to and from the overhead crane truck. When a broken or worn wheel assembly requires removal, mechanics need only to manually unbolt the assembly from the truck. Similarly, when a spare wheel is to be installed, the floor crane raises the wheel to the level of the overhead crane and rail and then guides the wheel assembly longitudinally along the rail to a location beneath the truck such that a mechanic can now bolt the spare assembly to the truck.

THE DRAWINGS

Figure 1:
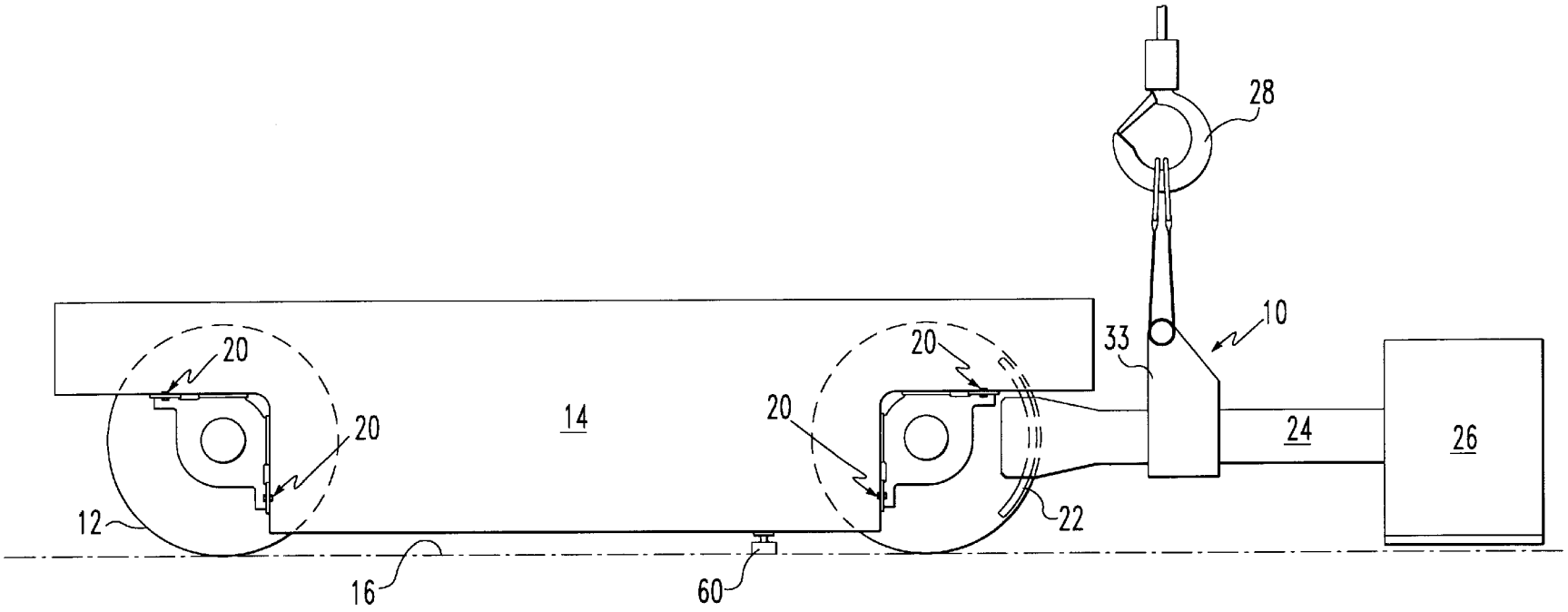
Figure 2:
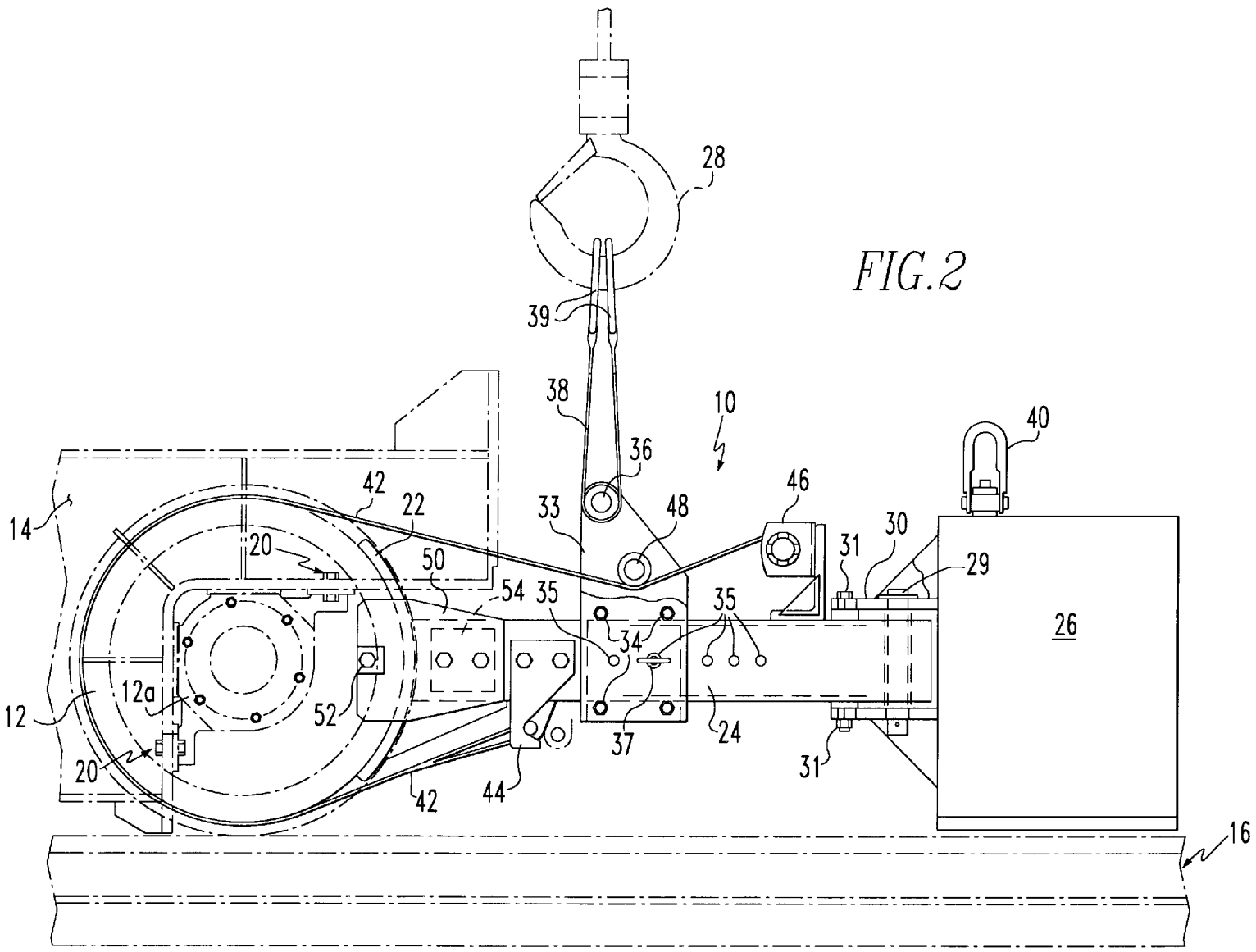
Figure 3:
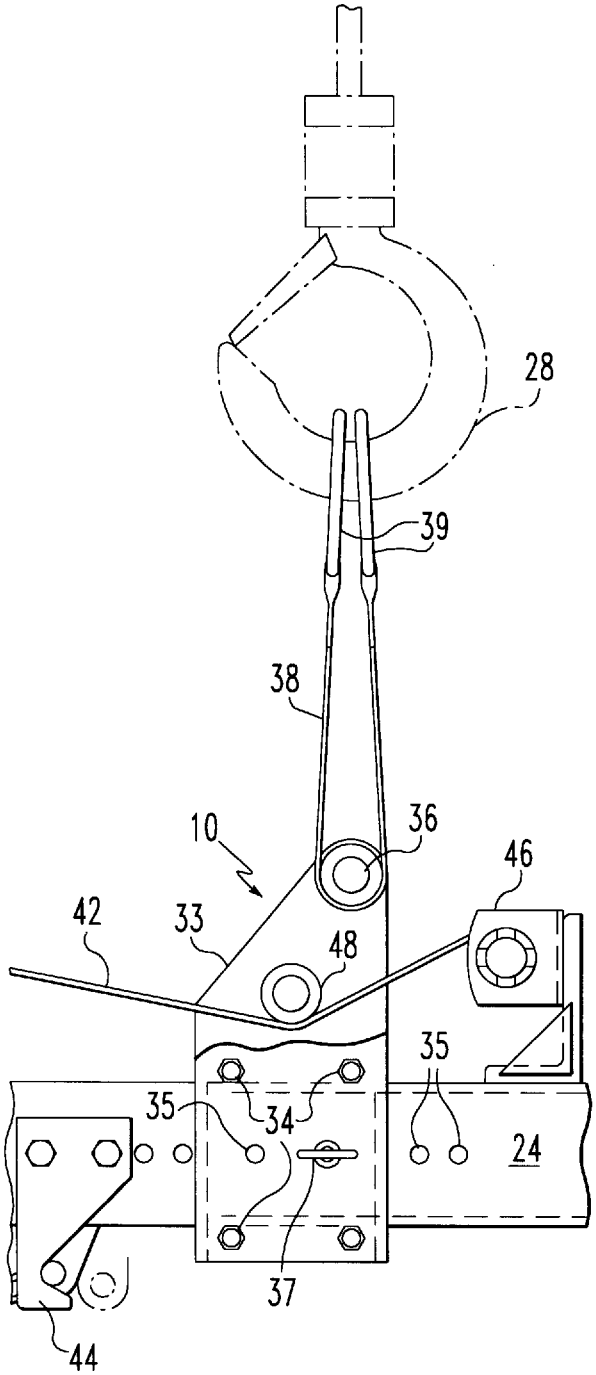

The invention, along with its objectives and advantages, will be better understood from consideration of the following detailed description and the accompanying drawings, in which:

FIG. 1 is a diagrammatic side view of an overhead crane truck and the wheel puller of the invention, FIG. 2 is a side elevation of the wheel puller of the invention and a truck wheel assembly shown in phantom, FIG. 3 is a partial side elevation view of the wheel puller showing a lifting bracket located in a position reversed to that of FIG. 1 for handling a wheel assembly that is lighter in weight than the wheel assembly shown in FIG. 2, and FIG. 4 is a plan view of the wheel puller depicted in FIG. 2.

PREFERRED EMBODIMENT

Referring now to the figures of the drawings, details of a crane wheel puller 10 are shown in FIGS. 2 to 4 for removing and installing flanged wheels 12 (i.e., wheel assemblies) in end trucks 14 of an overhead crane (in partial outline in FIG. 2), one such truck being diagrammatically depicted in FIG. 1. As shown in FIG. 1, truck wheels 12 rest on rails 16 that extend longitudinally in a plant or factory at a location above men, material and equipment located on the floor of the plant or factory. As seen in FIG. 4, wheels 12 have flanges 18 that extend to locations on each side of rail 16.

As explained earlier, wheels and wheel assemblies 12 are subject to wear and damage such that they need to be removed from a truck 14, lowered to ground level or other at-rest position, and a new or repaired (spare) wheel (wheel assembly) raised to the location of the truck and rails, and installed on the trucks.

Hereinafter, when referring to wheels 12, the term "wheel" includes a wheel assembly 12*a*, such as shown in dash outline in FIG. 4 of the drawings, that includes not only the flanged wheel per se but its bearings, bearing housing, shafts and other components that comprise such an assembly. The assembly is fastened to the truck by bolts 20, shown in phantom in FIG. 2. Two or more wheels 12 (on each side of an end truck) can be driven through a power shaft and gear reduction arrangement (not shown), the shaft being driven by a suitable motor.

Wheel puller 10 includes a curved saddle structure 22 shaped to engage the periphery of wheel 12, the saddle being suitably connected to one end of a beam 24. The curved saddle has an arc that can be chosen to fit the periphery of the largest diameter wheel to be handled by wheel puller 10. In this manner, any lesser diameter wheel can be received by the saddle. At the other end of the beam is a weight 26 sized to counterbalance the weight of wheel assembly 12 and saddle 22 when beam 24 is engaged by a hook 28 and the wheel puller lifted in a manner presently to be described.

For reasons also explained hereinafter, weight member 26 is attached to its end of beam 24 by means 29 that allows the weight member to swing or rotate about the end of the beam in the horizontal plane of the beam, as seen in FIG. 4. Means 29 can be a pin, as seen in FIG. 4, that extends through a U-shaped bracket 30 seated on the end of the beam, and through the beam. The bracket is suitably attached to weight member 26. The weight member can be maintained in a chosen rotated position by a nut and bolt arrangement 31 tightened on the bracket and beam, i.e., the bolt extends through the beam and through curve openings 32 (only one visible in FIG. 4) provided in bracket 30 in the manner shown in FIG. 4. Curved openings 32 allow bracket 30, and thus weight member 26, to pivot about pin 29.

Beam 24 is provided with two lifting brackets (plates) 33 for location respectively on opposed sides of the beam. The brackets are attached to the beam by fasteners 34 that extend through the brackets at locations above and below the beam. In addition, the brackets and beam are provided with corresponding openings 35 spaced lengthwise of the beam such that the brackets can be placed and maintained, using a pin 37 inserted through openings 35, at different locations along the beam to change the center of gravity of the wheel puller 10 when needed. In addition, brackets 33 can be reversed in the manner of FIG. 3, from that of FIG. 2, to change the center of gravity between beam 24 and weight 26. The "reversal" of brackets 33 involves an offset location 36 at which the brackets are engaged by a lifting sling 38. "Location" 36 involves a roller extending between and secured to the brackets for receiving the sling, which sling is then suitably engaged by hook 28 (FIGS. 2 and 3) being inserted through rings 39 attached to the sling; the hook is part of the means for lifting the wheel puller. By reversing the orientation of roller 36, the center of gravity of the wheel puller is altered (see again FIGS. 2 and 3). This is a convenient way to change the center of gravity of the wheel puller for handling wheels of different weights.

In addition to the sling receiving roller 36, wheel puller 10 can be lifted via a lifting eye 40 provided on and suitably fastened to the weight member 26 itself. When lifting the wheel puller without a wheel assembly, hook 28 is inserted through eye 40 for a balanced unloaded lift, i.e., the location of lifting eye on the weight member is such that beam 24 and weight member 26 are substantially balanced when lifted from an at-rest position by lifting hook 28.

Wheel 12 is securely attached to wheel puller 10 by a high strength strap 42 having a finite length and a width that allows the strap to seat between flanges 18 of the wheel. One end of the strap is connected to a bracket 44 located on and secured to the lower side of beam 24, while the other end of the strap is fed into a winch device 46 also mounted on beam 24. The winch includes a ratchet wheel and pawl (not visible in the drawings). The strap wraps around a spool of the winch, and the winch can be manually cranked to tighten strap 42 on the peripheral rim of the wheel, the ratchet and pawl holding the strap taut when the pawl seats into teeth of the ratchet wheel. The strap is released when the pawl is removed from the teeth.

Strap 42 passes between brackets 33, and under a roller 48 (FIGS. 2 and 3), also located between the brackets, to increase the distance the strap extends around and engages the periphery of wheel 12.

Wheel puller 10, as depicted in FIGS. 2 and 4, also includes two plates 50 that serve to trap the flange 18 of wheel 12 in the wheel puller, using opposed safety keeper bolts 52 threaded through the plates, to locations behind wheel flanges 18, as seen in FIG. 4. The plates are suitably fastened respectively to opposed sides of beam 24, and spacers 54 (FIG. 4) can be used between the plates and beam to adjust the distance between the plates for wheel flanges having different widths.

The system and apparatus of wheel puller 10 is employed in the following manner. When a wheel assembly of an overhead crane requires replacement, the wheel puller is first brought to the location on the floor beneath the crane. Without a wheel assembly attached to the wheel puller, the wheel puller can be picked up by inserting hook 28 of a floor operated mobile crane in the hook eye 40 located on the upper surface of counterweight 26, and brought to the floor location beneath the overhead crane. The location of hook eye 40 is such that the weight or mass of beam 24 is balanced by counterweight 26.

The hook 28 of the floor crane is now removed from hook eye 40 and inserted into the rings 39 of sling 38, as shown in FIGS. 2 and 3. The spare wheel assembly to be installed in place of the wheel assembly to be removed is now made available to balance the wheel puller for the task of removing and lowering the wheel assembly needing replacement. Plates 33 are positioned and oriented (FIG. 2 vs. FIG. 3) along the extent of beam 24 after the spare wheel assembly is strapped to saddle 22 of the wheel puller to determine the center of gravity of the wheel puller and the attached spare wheel assembly. The center of gravity not only includes the mass of counterweight 26 and the wheel assembly 12 that is in line with the longitudinal axis of beam 24, but must also include any unbalanced mass 12*a* of the wheel assembly extending to one side of the assembly. This is shown in phantom in FIG. 4. To balance mass 12*a*, weight member 26 is rotated about pivot pin 29 in the direction opposite 12*a*, as shown in FIG. 4. The angle at which the weight member is set to balance wheel components 12*a* can be marked on beam 24 if the weight member must, for some reason, be realigned with the axis of beam 24.

With wheel puller 10 suitably balanced, the spare wheel assembly is unstrapped and removed from the wheel puller, and hook 28 of the mobile crane is manually removed from rings 39 and inserted into lifting eye 40 on weight member 40. The boom of the mobile crane lifts the wheel puller to the level of the truck, and carries the wheel puller longitudinally into a position beneath the portion or corner of truck 14 containing the wheel assembly needing replacement. This portion of the truck is raised by a suitable jack 60 (FIG. 1) employed by a mechanic or other workman working from the location of the catwalk located at the level of rails 16. The truck and wheel assembly are raised from the rail by an amount sufficient to clear wheel flanges 18 from the rail. Mechanics working at the level of the catwalk assist the floor crane in guiding the wheel puller beneath the truck, and proceed to place strap 42 around the periphery of wheel 12 and thus into the space between its flanges 18.

Strap 42 is now tightened on the wheel by operation of winch and ratchet 46, and a mechanic moves hook 28 from eye 40 to rings 39 and wraps strap 38 under roller 36. At this time, safety keeper bolts 52 are tightened onto the wheel web. Then the mechanic removes bolts 20 that secure the wheel assembly 12*a* to the truck. When the bolts are removed, the assembly is free to be moved longitudinally along rail 16 by the boom of the floor crane, and then lowered to floor level or other suitable place of rest. Again, before lowered, counterweight 26 can be appropriately rotated to balance the mass of 12*a*.

Strap 42 is now loosened from the wheel of the assembly removed from truck 14 by release of ratchet 46, and bolts 52 are loosened to free wheel flanges 18. The strap is then placed about the wheel of the spare assembly. Again, the strap is tightened on the spare wheel by the winch of 46 and bolts 52 tightened. Then, the assembly is lifted to the level of truck 14. The corner or portion of the truck supported by jack 60 is still in a raised position by the jack such that the spare wheel assembly can be guided into place beneath the raised corner. A mechanic now fastens the assembly to the truck using bolts 20. Bolts 52 are now loosened and the mechanic also moves hook 28 from rings 39 to eye 40 while puller 10 is attached to the spare wheel and thereafter loosens strap 42 on the wheel. During this procedure, the wheel assembly and wheel puller are supported by hook 28 and strap 42, i.e., hook 28 holds the wheel assembly and wheel puller during the strap-up process; strap 42 holds the wheel and puller assemblies together in the process of moving the hook from rings 39 to eye 40. The strap is removed from the wheel, and wheel puller 10 is lowered to a position and location for future use.

In all of the above procedure, the mechanical tasks of wheel changing are relatively safe, as the mechanics and other workmen do not need to manhandle a heavy unsupported wheel assembly from locations high above ground level. If wheel puller 10 is used in areas of high magnetic fields, the wheel puller and the boom of the floor crane are used to control wheel movement and to free the wheel and/or wheel puller from ferrous structures it becomes attached to because of the magnetic fields. In addition, wheel puller 10 can be used to handle wheel assemblies of different sizes and weights since lifting plates 33 can be relocated lengthwise of beam 24, and reoriented to change the center of gravity of the system of the wheel puller and associated wheel assemblies. Further, laterally located masses, such as 12*a*, can be balanced by rotating counterweight 26 (FIG. 4), and different wheel widths can be accommodated by the use or removal of spacers 54 placed between wheel clamps 50. Further adjustments can be made to accommodate other wheel weights by having various sizes of weight 26, for example, 1000 lbs., 1500 lbs., 2000 lbs.

What is claimed is:

1. A wheel puller for handling a heavy wheel assembly, comprising:

a beam having one end for securing a heavy wheel assembly thereto, and an opposed end having a weight member connected thereto, said weight member having a mass comparable to that of the wheel assembly and being connected to the beam end by pivot means that allows the weight member to be rotated horizontally about said beam end, and means provided on said beam at a location intermediate the beam ends for receiving the hook of a lifting device.

2. The wheel puller of claim 1 wherein the means for receiving the lifting hook includes apparatus for changing the location of said means on the beam, and thus for changing the center of gravity of the wheel puller with or without a wheel assembly secured to the beam.

3. The wheel puller of claim 2 wherein the lifting device and the means for changing the location at which the lifting hook is received includes a plurality of through openings spaced lengthwise of the beam, and two plates for respective disposal on opposed sides of the beam, said plates having spaced apart openings corresponding to those of the beam for receiving at least one removable pin insertable through said openings when the plates are located on the opposed sides of the beam.

4. The wheel puller of claim 3 wherein the two plates are provided with means for receiving a sling at a location that is laterally offset from the center of the two plates.

5. The wheel puller of claim 1 wherein the wheel of the assembly is secured to a saddle located at the one end of the beam by a strap being disposed about a peripheral portion of the wheel and attached to the beam.

6. The wheel puller of claim 5 wherein a winch means is located on the beam to tighten and loosen the strap on the periphery of the wheel.

7. The wheel puller of claim 1 wherein the weight member is provided with a lifting eye at a location that balances the masses of the beam and weight member when no wheel assembly is secured to the one end of said beam.

8. A wheel puller for handling a heavy wheel assembly, comprising:

a beam having two ends, a strap for securing a heavy wheel assembly to one of said ends, a weight member connected to the other of said ends by pivot means that allows the weight member to be rotated horizontally about said beam end, said weight member having a mass comparable to that of the wheel assembly secured to the beam end such that the weight member counterbalances the mass of the wheel assembly when a lifting device is connected to the beam at a location intermediate the wheel assembly and weight member and lifted from or to an at-rest position.

9. A wheel puller for handling a heavy wheel assembly, comprising:

a beam having two ends, a curved saddle located at one of said ends for receiving a wheel of the assembly, a strap for securing the wheel assembly to the curved saddle, and a weight member connected to the other of said beam ends by pivot means that allows the weight member to be rotated horizontally about said beam end, said weight member having a mass comparable to that of the saddle and wheel assembly such that the weight member counterbalances the masses of the saddle and wheel assembly when a lifting device is connected to the beam at a location intermediate the saddle and weight member and is lifted from or lowered to an at-rest position.

10. A wheel puller for handling a heavy wheel assembly, comprising:

a beam having one end for securing a heavy wheel assembly thereto, and an opposed end having a weight member connected thereto, said weight member having a mass comparable to that of the wheel assembly and being provided with a lifting eye at a location that balances the masses of the beam and weight member when no wheel assembly is secured to the one end of said beam, and means provided on said beam at a location intermediate the beam ends for receiving the hook of a lifting device.

11. The wheel puller of claim 10 wherein the means for receiving the lifting hook includes apparatus for changing the location of said means on the beam, and thus for changing the center of gravity of the wheel puller with or without a wheel assembly secured to the beam.

12. The wheel puller of claim 11 wherein the lifting device and the means for changing the location at which the lifting hook is received includes a plurality of through openings spaced lengthwise of the beam, and two plates for respective disposal on opposed sides of the beam, said plates having spaced apart openings corresponding to those of the beam for receiving at least one removable pin insertable through said openings when the plates are located on the opposed sides of the beam.

13. The wheel puller of claim 12 wherein the two plates are provided with means for receiving a sling at a location that is laterally offset from the center of the two plates.

14. The wheel puller of claim 10 wherein the weight member is connected to the beam end by pivot means that allows the weight member to be rotated horizontally about said beam end.

15. The wheel puller of claim 10 wherein the wheel of the assembly is secured to a saddle located at the one end of the beam by a strap being disposed about a peripheral portion of the wheel and attached to the beam.

16. The wheel puller of claim 15 wherein a winch means is located on the beam to tighten and loosen the strap on the periphery of the wheel.

17. A wheel puller for handling a heavy wheel assembly, comprising:

a beam having two ends, a strap for securing a heavy wheel assembly to one of said ends, a weight member connected to the other of said ends, said member being provided with a lifting eye at a location that balances the masses of the beam and weight member when no wheel assembly is secured to the one end of said beam, said weight member having a mass comparable to that of the wheel assembly secured to the beam end such that the weight member counterbalances the mass of the wheel assembly when a lifting device is connected to the beam at a location intermediate the wheel assembly and weight member and lifted from or to an at-rest position.

18. A wheel puller for handling a heavy wheel assembly, comprising:

a beam having two ends, a curved saddle located at one of said ends for receiving a wheel of the assembly, a strap for securing the wheel assembly to the curved saddle, and a weight member connected to the other of said beam ends, said member being provided with a lifting eye at a location that balances the masses of the beam and weight member when no wheel assembly is secured to the one end of said beam, said weight member having a mass comparable to that of the saddle and wheel assembly such that the weight member counterbalances the masses of the saddle and wheel assembly when a lifting device is connected to the beam at a location intermediate the saddle and weight member and is lifted from or lowered to an at-rest position.

* * * * *